US006905734B2

(12) United States Patent
Withers et al.

(10) Patent No.: US 6,905,734 B2
(45) Date of Patent: Jun. 14, 2005

(54) ONE PASS POLYURETHANE ROLL COVERING SYSTEM AND METHOD

(75) Inventors: William David Withers, Atlanta, GA (US); Thomas Cody Merrion, Kennesaw, GA (US); Charles Humbert Rhoads, Oxford, AL (US)

(73) Assignee: Coldwater Resins, Inc., Altanta, GA (US)

( * ) Notice: Subject to any disclaimer, the term of this patent is extended or adjusted under 35 U.S.C. 154(b) by 266 days.

(21) Appl. No.: 10/289,595

(22) Filed: Nov. 7, 2002

(65) Prior Publication Data

US 2003/0096063 A1 May 22, 2003

Related U.S. Application Data

(60) Provisional application No. 60/338,218, filed on Nov. 8, 2001.

(51) Int. Cl.[7] ..... B05D 1/02

(52) U.S. Cl. ..... 427/425; 427/427.3; 427/427.4; 427/421.1; 118/323; 118/320

(58) Field of Search ..... 427/421, 425, 427/421.1, 427.3, 427.4; 428/423.1; 239/337; 118/300, 320, 321, 323; 492/16, 17, 20; 162/119, 357

(56) References Cited

U.S. PATENT DOCUMENTS 3,009,209 A * 11/1961 Weinbrenner et al. ..... 264/54
4,267,299 A * 5/1981 Oechsle, III ..... 528/48
4,571,798 A * 2/1986 Adams ..... 492/37
5,176,940 A 1/1993 Salo et al. ..... 427/202
5,401,539 A * 3/1995 Coombs et al. ..... 427/422
5,702,578 A * 12/1997 Umeda et al. ..... 204/486
5,895,689 A 4/1999 Gajewski ..... 427/425
6,027,769 A 2/2000 Gajewski et al. ..... 427/425

OTHER PUBLICATIONS

Rotational Casting of Polyurethane Roll Coverings by John H. Perry, Bayer Corporation, 100 Bayer Road, Pittsburgh, PA., 15205.

Formulating Elastomer Spray Systems by John H. Perry, Bayer Corporation, 100 Bayer Road, Pittsburgh, PA., 15205.

Modular Drive System—Instructions and Parts Manual BUG–O Systems, A Division of Weld Tooling Corporation 3001 West Carson Street, Pittsburgh, PA., 15204.

Stata–Tube & Spiral Motionless Mixers—From TAH Industries, Inc. Data Sheet 75 dated Mar. 1994.

* cited by examiner

*Primary Examiner*—Katherine Bareford
*Assistant Examiner*—David Turocy
(74) *Attorney, Agent, or Firm*—Thomas, Kayden, Horstemeyer & Risley, LLP.

(57) ABSTRACT

A system and method is disclosed for applying polyurethane to a roll that is primarily used in the papermaking industry. One advantage of the present system and method is that the polyurethane may be applied to the roll in one pass of a traversing mechanism along the length of the roll while the roll rotates, thus significantly decreasing processing time of the roll.

19 Claims, 4 Drawing Sheets

ONE PASS POLYURETHANE ROLL COVERING SYSTEM AND METHOD

CROSS-REFERENCE TO RELATED APPLICATION

This application claims priority to now abandoned U.S. provisional application entitled, "One Pass Polyurethane Roll Covering System and Method," having Ser. No. 60/338,218 filed Nov. 8, 2001, which is entirely incorporated herein by reference.

TECHNICAL FIELD

The present invention is generally related to roll coverings and, more particularly, is related to a system and method for covering rolls that may be used in the pulp and/or paper industry.

BACKGROUND OF THE INVENTION

Polyurethanes are often used to cover rolls used in a variety of industries, e.g., paper, lumber, printing, steel, mining and textile industries. In particular, polyurethanes are often used when special properties are desired of the covered rolls, such as abrasion resistance, tear resistance, high load bearing with high hardness, and solvent resistance.

In the papermaking industry in particular, a plurality of rolls are used to transport a web or the paper from the beginning of the process through the end. In the process, a slurry of approximately 95% water and approximately 5% pulp fiber is transported via a web through machinery where water is extracted from the pulp, and the resultant pulp is then pressed and dried. In the process, a continuous sheet of paper is produced and wrapped onto a large metal roll for further processing. The rolls used in the papermaking process typically range in size from approximately 12 inches in diameter and a 100 inches long to approximately 60 inches in diameter and approximately 400 inches long. Fifty (50) to 250 rolls may be used in any one paper machine including the rolls at the end that the paper is wrapped upon, i.e., the reel spool. The outer diameter of these rolls is often covered with a rubber or polyurethane to protect the roll from corrosion and to help de-water the paper. They also provide traction for the webs used to transport the fiber and water sheet that is made into paper.

Polyurethane-covered paper machine rolls are known to have excellent abrasion resistance and corrosion resistance, vibration dampening and load-bearing ability. Further, polyurethane covered rolls help protect the web. The beginning of the papermaking machine 10, as depicted in FIG. 1, will typically carry the pulp on a web 12 (or "wire") and will typically form a continuous loop that may encompass from approximately five to approximately thirty rolls and can be from approximately 100 inches to approximately 400 inches wide. On the wet end of the papermaking machine 10, the wire 12 may be exposed to temperatures of approximately 120 to 180 degrees Fahrenheit (° F.).

The wire 12 is usually a polypropylene screen that spins in a continuous loop along the rolls. Typically, only one or two rolls are driven. The driven rolls drive the wire and the wire drives the other rollers. The wire 12 is consumable and may cost from approximately $60,000 to approximately $100,000 each and usually lasts only approximately two to nine months. In the press section of the process, depicted in FIG. 2, the wire 24 is usually referred to as a "felt." The polyurethane covering on rolls contacts this expensive consumable wire or felt at a pressure of approximately 15 to 60 pounds per linear inch to give the desired traction and performance.

Ideally, a roll and wire 12 track like a gear. If the wire 12 cannot keep up with the driven roll, then slippage occurs and the wire 12 is abraded and becomes worn. Anything that extends the life of the wire 12 or the felt 24 is considered a significant improvement in the process.

On the wet end of the papermaking machine 10, pulp is dispensed out onto the web 12 by a dispensing mechanism 14. The web 12 then travels across a series of foils 16 that de-water the pulp. Suction can be applied via the foils 16, or optionally, the foils 16 may have sharp edges that the pulp passes over that scrape the water off the bottom of the porous wire and creates a bit of vacuum on the trailing side of the pulp. After the pulp passes over foils 16, or optionally during passage over foils 16, a sheet of paper begins to form. The sheet disposed on web 12 then passes over vacuum boxes 18, and optionally beneath a dandy roll 19. After the sheet passes over the vacuum boxes 18, traditionally the sheet continues on to the press section 20, while the web 12 runs between at least one couch roll 21 and a suction pickup roll 22, and returns via guide rolls 23 to the beginning of the papermaking machine 10. Configurations vary by grade of product manufactured, but the process is essentially the same in all.

In the middle or press section 20 of the papermaking machine 10, as depicted in FIG. 2, the web is pressed between large press rolls 26 that may or may not apply suction through holes in the face of one of the press rolls. The cover on the rolls 22 helps determine the width of the nip and the pressure on the web 12. The sheet of paper, when picked up by the suction pickup roll 22, is pulled off of web 12 and onto the felt 24. The felt 24 comes around through the press and then is squeezed. The paper at this point is strong enough to accept a nip. In the press section 20, the paper and felt 24 may get nipped two or three times, and be transferred from one felt section to another felt section. As shown in FIG. 2, for example, the sheet of paper may pass through three felt sections.

On the dryer section 30 of the papermaking machine, as shown in FIG. 3, the web 12 is usually passed over steam-heated cylinders 32 that may be of a 350° F. internal steam temperature. In the dryer section 30, the sheet of paper is usually strong enough to be separated from the web 12 and travel on its own strength for short distances. While the paper may still be approximately 65% water, the fibers are usually bonded together enough from pressing and de-watering to form a sheet. In the dryer section 30, the paper travels back and forth through a series of steam-heated dryers 32. A felt may be used in the dryer section 30 to hold the paper down against the dryer cylinder 32 and to further absorb the water that is coming out of the paper.

At the very end of the papermaking machine 10 in section 40, as shown in FIG. 4, the paper may go through a calender reel 42, to which various coatings, sizings, etc. may be placed on the paper, e.g., for printability. The paper is then wound up on a reel spool 44.

The typical process for applying polyurethane to the rolls described hereinbefore is a vertical casting process where the roller is picked up on one end and lowered into a mold that is customized for the roller. The mold is then poured, casting the bigger outer diameter on the outside of the roll. Post curing typically takes place in the mold. The roll is then removed from the casting and then tooled or ground to get the evenness and finish that is desired on the surface of the polyurethane.

There are some problems associated with the vertical casting process; for example, the polyurethane may disbond from the roll. Further, bubbles may be formed in the polyurethane which it is necessary to remove. An additional problem with conventional casting processes is that the custom molds are built for each roll and the polyurethane is cast with a large amount of extra stock on them because of surface defects that occur in the mold due to gas bubbles and the abuse to which the mold is subjected. This is an extremely time-consuming and expensive process and requires a lot of storage space for the molds. Further, the conventional casting process is probably not necessary for 85% of rolls in paper-making process that do not need to withstand high temperatures and/or high pressure.

Another process used for applying polyurethane to the roll is a rotational casting process, which is performed horizontally. In the rotational casting process, polyurethane is ribbon-flowed onto the surface of a shell as it rotates. The head of a polyurethane-dispensing mechanism traverses the roll, extruding polyurethane onto the surface of the roll at a very low pressure and flow rate. Because the polyurethane is a liquid when dispensed, the liquid must be slowly extruded so that it does not drip off of the roll during the dispensing process. Further, the polyurethane in the traditional rotational casting process is only applied in a four-inch width, and under a pressure of approximately 1,000 pounds per square inch (psi) or less.

Additionally, traditional rotational casting processes require that the roll be placed in an oven for curing, as well as additional post-cure cooling time before machine grinding the roll. The traditional rotational casting process can take up to approximately 16 hours from beginning until the roll is removed from the oven. Adding in post-curing time, it can take up to approximately 24 hours to completely cover one roll before machining or grinding can begin.

The polyurethanes that are processed in the rotational casting process are typically made from polyethers. One problem with the polyether chemicals suitable for this process is that they cannot be used in the wet end of the paper machine (FIG. 1) because they absorb too much water. Therefore, they are usually used only on reel spools 44 at the very end section 40 of the machine 10 (FIG. 4). This is a more limited market, and is also a very expensive technology.

Rubber has also been used to cover and protect the rolls and is the oldest technology that has been used to cover rolls. The rubber is typically applied in an extrusion process that extrudes a ribbon on the roll starting at one end and traversing to the other, as the roll rotates. A lot of excess rubber is usually applied because the rubber has to be vulcanized on the entire roll and it shrinks in this process. An additional problem with the use of rubber is the requirement of an oven that is big enough to accommodate the entire roll core. The rubber is then cooked until it is cured on the core, resulting in a shrinkage that stresses the cover. The rubber then has to be rough tooled and ground to get the straightness and finish that is needed on the surface of the cover. Because the process of applying rubber is very inaccurate, a large amount of wasted material is usually machined off to create the desired surface. For example, in a typical process of preparing a rubber-covered roll, approximately 0.250 inch per side (0.5 inch on diameter) to approximately 0.5 inch per side (1.0 inch on diameter) is machined off. The process of applying rubber to the typical papermaking roll may take approximately three to four days, which renders this a time consuming process.

In the rubber extrusion process, for example, a ribbon of rubber is extruded that may be one-half inch (½ in.) wide and approximately one quarter (¼) to three-eighths (⅜) of an inch thick. That is sometimes accomplished at an angle, or vertically with the narrow end against the roll. The result is a very rough surface as the rubber is extruded because each ribbon is pressed against another ribbon, as they are stacked in multiple layers. Because the layers of rubber are being pressed, the top layer tends to bunch up more in the area of the joints. This can lead to as much as one-quarter of an inch (¼ in.) difference in the surface between the low spot and the high spot between the center of one ribbon and the joint with the next ribbon. The result is that this portion of the rubber must be machined off once it is cured. Therefore, a lot of stock must be removed in order to obtain a 100% clean rubber surface, which results in a large amount of wasted material.

Polyurethane has also been dispensed on to various objects, from truck beds to roll covers, through a spraying mechanism. The problem with the typical spraying process, however, is that the polyurethane is typically applied in only approximately $^{40}/_{1000}$ of an inch in a pass, and therefore a three-quarter inch (¾ in.) cover would require approximately 20–40 passes about the roll in order to build up the thickness of the polyurethane.

Thus, a heretofore unaddressed need exists in the industry to address the aforementioned deficiencies and inadequacies.

SUMMARY OF THE INVENTION

The present invention provides a system and method for applying polyurethane to rolls that may be used in the papermaking industry.

Briefly described, one embodiment of the method, among others, can be summarized by the following steps: providing a cylindrical roll having two ends and a surface, wherein the cylindrical roll is attached to a variable speed turning fixture on said ends of the roll; providing a variable speed traversing mechanism having a nozzle to atomize the polyurethane; providing polyurethane under high pressure; and covering the surface of the roll with up to three inches of polyurethane, on the diameter, in one pass of the traversing mechanism along the length of the roll while rotating the roll via the variable speed turning fixture. One advantage of the present method is that it is a continuous operation, with all material applied in one pass down the roll, and in which there is minimal delay in waiting for the roll to cure, as curing happens without the addition of heat. Thus, post-curing time does not inhibit processing of the roll. Post-cure time at 70° F. is approximately three (3) hours for most rolls, with no supplemental heat source necessary.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

A system and method has been developed that allows efficient and easy application of polyurethane to cover rolls that may be used in the papermaking industry. Rolls used in the paper-making industry that may be covered with polyurethane using the system and method of the present invention include, but are not limited to, the following: breast rolls, wire rolls, wire return rolls, wire turning rolls, wire drive rolls, felt rolls, paper rolls, stretch rolls, guide rolls, press rolls, suction rolls, fly rolls, breaker stack rolls, size press rolls, lead-in and lead-out rolls, coater rolls, coater backing rolls, dryer felt rolls and reel spools.

Figure 5:
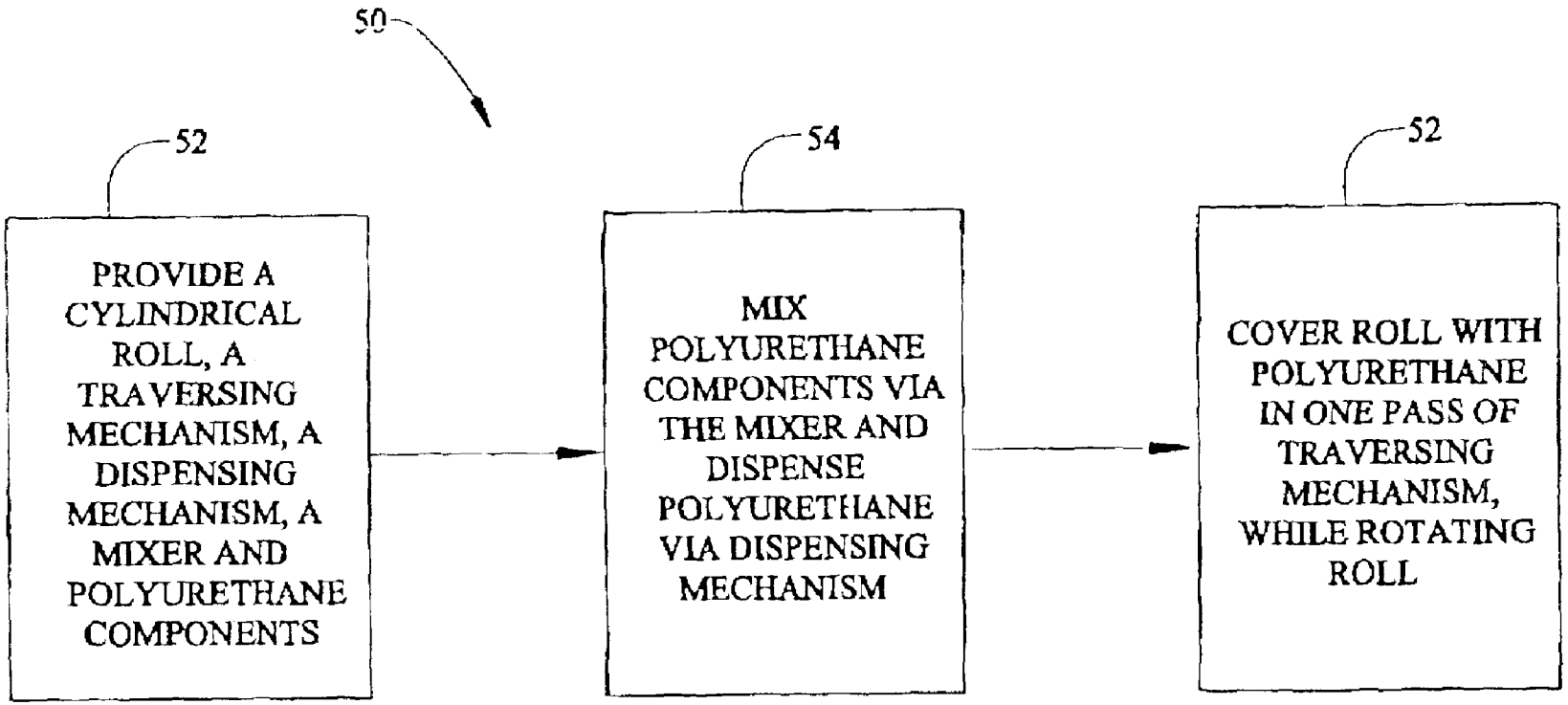
FIG. 5 is a flow chart of one embodiment of the method of the invention.

Referring now to the drawings, FIG. 5 depicts in brief a flowchart of the method 50 of the present invention. As shown in block 52, a cylindrical roll, a traversing mechanism, a mixer and polyurethane components are provided. The roll may undergo surface preparation prior to being provided in block 52 of method. For example, a prior-applied cover may need to be removed. Further, the roll is typically cleaned, degreased, and then grit- or sand-blasted. The roll may then be blown with clean, dry air, and its temperature brought to at least approximately 50 degrees Fahrenheit (° F.) if necessary. Additionally, it is desired that the temperature of the roll exceed the dew point before proceeding to the next step.

Returning to FIG. 5, as depicted in block 54, the polyurethane components are mixed in a mixer and are dispensed via the traversing mechanism onto the roll. As shown in block 56, the roll is covered with polyurethane up to approximately one and a half inches thick per side (three inches on diameter) in one pass of the traversing mechanism while the roll rotates. It could be envisioned by one skilled in the art that any or all step(s) of the process of the present invention can be automated or performed manually.

Application Ser. No. 60/338,214 entitled "One Pass Polyurethane Roll Covering System and Method," to which the present application claims priority, refers to "coating" the rolls with polyurethane. It would be understood to one skilled in the art that the term "coating" as used in that application is interchangeable with the term "covering" as used herein.

Figure 6:
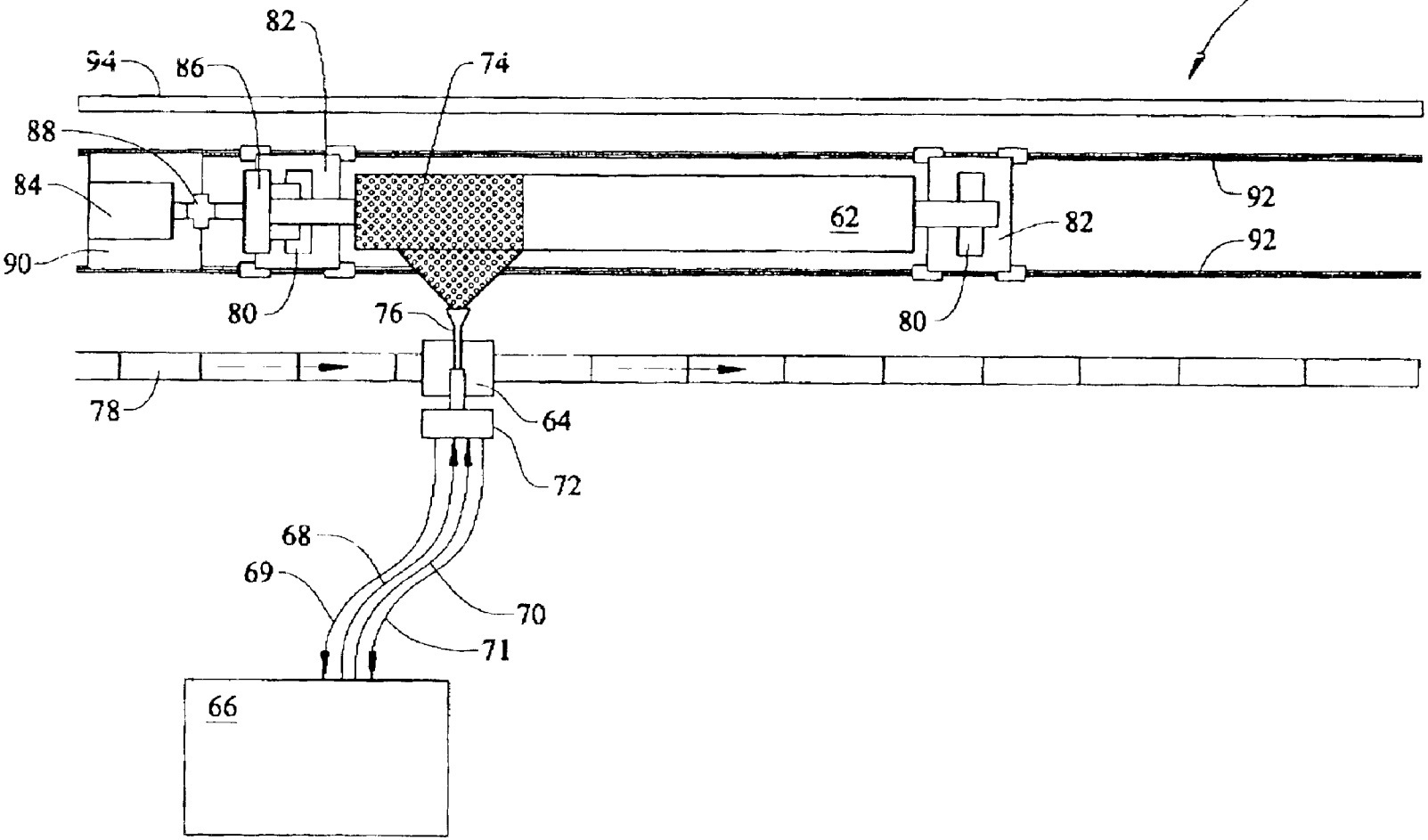
FIG. 6 is a top view of a system used to accomplish the method of FIG. 1.

FIG. 6 depicts the system 60 that is used to accomplish the method 10 of the invention. The system includes a roll 62 that may be comprised of, for example but not limited to, metal, rubber, polyurethane, epoxy, and/or carbon fiber. As noted before, preferably the roll 62 is grit-blasted prior to application of polyurethane 74, and is free of substantially all dirt, grease, debris, or other impediments that would prevent polyurethane 74 from adhering evenly to roll 62.

As shown in FIG. 6, roll 62 is covered with polyurethane 74 and a traversing mechanism 64 is used to apply polyurethane 74 to the roll 62. The traversing mechanism 64 is connected to a formulator proportioner 66 via the curative spray hose 68 and curative recirculation hose 69 and the resin spray hose 70 and resin recirculation hose 71. The formulator proportioner 66 is the device that correctly proportions the ratio of curative to polyurethane resin. From the formulator proportioner 66, the curative and resin move and recirculate through hoses 68, 69, 70 and 71 to mixer 72 of the traversing mechanism 64. In the mixer 72, the curative and resin are mixed, in the proportions determined by the formulator proportioner 66. Mixer 72 may be any conventional mixer known to those skilled in the art, for example, either the static-tube mixers or spiral mixers manufactured by and commercially available from TAH Industries, Inc. of Robbinsville, N.J., USA.

The polyurethane 74 is comprised of the resin and curative. Prior to mixing, the resin and curative may have a viscosity of, for example but not limited to, approximately 350 centipoises. Prior to application of the two components, the two components are preferably brought to a temperature to match their viscosities, and the polyurethane mixture 74 may have a viscosity greater than, for example, approximately 100,000 centipoises. The two components are mixed in the mixer 72, and then pumped to the dispensing mechanism 76 via an airless pumping system (not shown). Mechanical positive displacement, single-ended, linear, reciprocating pistons may be used to apply the resin and curative mixture. The pumping system may comprise chrome hardened shafts and sleeves. The dispensing mechanism 76 is any device capable of dispensing the polyurethane in a fan configuration under high pressure. Preferably, the dispensing mechanism 76 is, for example, but not limited to, a nozzle.

The resin may be any polyol known in the art that is used in the production of polyurethane. In one embodiment the resin may be, for example but not limited to, a polyester/polyether blended polyol. The curative may be any curative known in the art, for example but not limited to, an isocyanate, for example, polymeric diphenylmethane diisocyanate—4,4 (MDI). Suitable ratios of resin to curative range from, for example but not limited to, a ratio of approximately 1 part resin to approximately 1 part curative (1:1), to a ratio of approximately 5 parts resin to approximately 1 part curative (5:1). The polyurethane constituents are preferably kept within a specified temperature range. The resin is usually maintained at a temperature, for example but not limited to, from approximately 100° F. to approximately 150° F. The curative may be maintained at a temperature, for example but not limited to, from approximately 60° F. to approximately 130° F.

Returning to FIG. 6, from the traversing mechanism 64, the polyurethane 74 is dispensed via dispensing mechanism 76 onto roll 62. During application of the polyurethane 74, the pressures and flow rates of the mixture of the two components (resin and curative) are monitored as it flows from the mixer 72 through the dispensing mechanism 76. The polyurethane may be applied at a rate, for example but not limited to, from approximately 0.15 gallons per minute (gal/min) to approximately 2.0 gal/min. The polyurethane 74 is, in a preferred embodiment, dispensed at a pressure of approximately 1,000 pounds per square inch (psi) to approximately 5,000 psi. More preferably, the polyurethane 74 is dispensed under a pressure of approximately 1,500 psi to approximately 3,000 psi. More preferably, polyurethane 74 is dispensed under a pressure of approximately 2,000 psi to approximately 2,500 psi, but this can vary depending upon the specific characteristics of the polyurethane being applied. In particular, it is desirable to atomize polyurethane 74 being dispensed, and dispense it onto roll 62 at a pressure that does not exceed the pressure at which impact deflection off of roll 62 occurs.

The traversing mechanism 64 is situated upon a track 78 which allows the traversing mechanism 64 to pass along the length of the roll 62 while dispensing the polyurethane 74. A carriage and rails that may be used in the present invention, for example, are commercially available from and manufactured by Bug-O Systems of Pittsburgh, Pa., USA.

Polyurethane 74 is dispensed via dispensing mechanism 76 onto roll 22i n a fan configuration, as depicted in FIG. 6. The exemplary fan-shaped configuration shown in FIG. 6 can be up to approximately 30 inches wide. Alternatively, the polyurethane being dispensed covers from approximately six to thirty-six inches of the longitudinal portion of the roll. This represents a vast improvement over traditional processes that dispense polyurethane as a thick liquid, where the width in which polyurethane is dispensed is only approximately four inches wide.

As noted previously, polyurethane 76 is dispensed via dispensing mechanism 76 while roll 62 is rotating. In a preferred embodiment, the layer of polyurethane 74 on the cylindrical surface of the roll 62 applied on a previous rotation of roll 62 is not completely cured after one rotation of roll 62. Thus, the polyurethane 74 presently being dispensed from the dispensing mechanism 76 becomes homogenous with the previous layer of polyurethane 74 already applied to the surface of the roll 62.

In a preferred embodiment approximately 20% of the fan-shaped configuration of polyurethane 74 being dispensed contacts an uncovered longitudinal portion of the roll 62 during each revolution. Thus, approximately 80% of the fan width is contacting polyurethane already applied to the roll, while the remaining approximately 20% of the width of the fan-shaped configuration is contacting an uncovered portion of roll 62.

Each end of the roll 62 is disposed upon V-block supports 80 for the bearings (not shown) of the roll 62. The V-block supports 40 are positioned upon movable support stands 82 for the roll 62. Optionally, the support stands 82 may be movable or stationary. At least one end of the roll 62 is attached to a variable speed turning fixture 84 via a self-aligning three jaw chuck 86 and a universal joint 88. The turning fixture 84 is disposed upon a support stand 90. The turning fixture 84 may turn the roll at a rate, for example but not limited to, from approximately 3 revolutions per minute (rpm) to approximately 50 rpm.

If the support stands 82 are movable, they may be situated upon rails 92 for moving the movable support stands 80 and the roll 62, upon completion of the application of the polyurethane 74. Optionally, the movable support stands 82 may have wheels attached (not shown) which allow for movement of stands 82 and which may lock upon being positioned at correct locations. The distance between the two stands 82 can be increased or decreased to accommodate rolls 62 of various sizes. An optional backdrop 94 may be provided to protect any person or object located on the opposite of the roll 62 from the traversing mechanism 64.

Effectively applying polyurethane 74 to roll 62 is a balance of chemistry and mechanics of the cure rates in terms of mixing the curative and resin in the mixer 72 at the appropriate temperature, and for the appropriate amount of time prior to applying polyurethane 74 to roll 62. The temperature at which the polyurethane 74 may be applied to roll 62 is fairly broad, for example, but not limited to a range of approximately mid-40's to approximately high 90's ° F., and preferably greater than 50° F., and above the dew point. The polyurethane 74 covering the roll has a thickness of up to approximately three inches with a viscosity of approximately 10,000 centipoises in the liquid state prior to hardening.

During each revolution of the roll 62, polyurethane 74 is applied via the dispensing mechanism 76 in a layer approximately $\frac{1}{2,000}$ inch to approximately $\frac{1}{10,000}$ inch thick. Preferably, the layer of polyurethane 76 applied during each revolution is approximately $\frac{1}{5,000}$ inch thick. Thus, when a layer of approximately $\frac{1}{2,000}$ inch to approximately $\frac{1}{10,000}$ inch thick of polyurethane 74 is applied in a spray at a temperature of approximately 110 degrees F. to a surface of the roll 62 at approximately 70 to 73 degrees F., and at a pressure of approximately 2,500 psi, the polyurethane 74 maintains a viscosity, for example, for approximately five (5) to 30 seconds such that polyurethane 74 being applied to the surface becomes homogenous with a previous layer of polyurethane 74 already applied to the surface of roll 62.

The process usually takes approximately three and a half (3.5) to six and a half (6.5) hours from the beginning of the application of polyurethane 74 to roll 62, until the roll 62 is taken to be machine ground, at approximately 70° F. Therefore, in the time it takes to finish the application of polyurethane 74, turn off the traversing mechanism 64, clean the area in and around the system 62, and move the roll 62 to the next station (not shown) to be machine ground, the appropriate amount of time has elapsed, approximately two and a half (2.5) to three and a half (3.5) hours, so that the roll 62 with the polyurethane 74 applied may be immediately machine ground. In particular, the rolls covered with polyurethane 74 via the process of the present invention reach approximately 85% of their ultimate hardness within three hours of covering, at 70° F., and are machineable at that point. Thus, post-curing time does not inhibit processing of roll 62.

After application of polyurethane 74 to roll 62, the roll may be taken to a lathe and/or roll grinder, where the surface may be finished either with a tool or belt or wheel. An additional advantage of the present invention is that a very small amount of the polyurethane material lost or wasted during the method 10 because the application process of the polyurethane 74 is very accurate. For example, wasted material will typically range from approximately 0.025 inch per side (0.050 inch on diameter) to approximately 0.075 inch per side (0.150 inch on diameter). Typically, the diameter checks come within $\frac{10}{1,000}$ths of an inch of conformity with the desired diameter, dependant upon the accuracy of the roll diameter. Thus, there is much less polyurethane material wasted in order to obtain a usable surface on the covered roll than with conventional polyurethane application processes.

In addition to the timing of addition and mixing, and the temperature of the mixture of the resin and curative in mixer 72, the cure rate of the polyurethane 74 is an important aspect of the method. The application rate of the polyurethane 74 to the roll 62 is preferably controlled so that the polyurethane 74 does not run or drip off of the roll 62 and onto the floor. The cure rate of the polyurethane mixture 74 can be controlled by the rotation of the roll 62, the size of the dispensing mechanism 76, or the rate at which the traversing mechanism 64 traverses the roll 62. These parameters that affect the cure rate usually are a function of the size of the roll 62.

The time for curing may also depend on such conditions as, for example, ambient temperature, surface temperature of the roll 62, starting materials used (including presence of any impurities), and temperature of polyurethane 74. The time for curing, so that the polyurethane 74 is hard to the touch, may range from approximately 10 minutes to approximately 20 minutes at a temperature of 70° F. The roll 62 may be taken to a sanding or grinding machine after application of polyurethane 74 by the present method after only approximately 180 minutes at 70° F. The roll 62 may be installed and used in a paper machine after approximately 36 hours at 70° F. temperature, when polyurethane 74 is applied via the present method 50.

The polyurethane 74 may be tested prior to application of the polyurethane 74 to the roll 62 in order to determine that the thixotropic properties of the polyurethane 74 procedure are correct. The test may include inserting a wooden stick into the polyurethane mixture, immediately pulling it out, and accurately timing the number of seconds is takes for the polyurethane 74 to run off the stick. In a preferred embodiment of the test parameters of this test, the polyurethane would adhere to the wooden stick for approximately 50 seconds, but does not adhere to the wooden stick for more than approximately 60 seconds. The cure rate of polyurethane 74 may also be tested in a closed cup test with a known Shiyodou gel timer.

The cure rate of polyurethane 74 tested via this method is preferably from approximately 4.5 minutes to approximately 6 minutes, depending upon the ratio of the constituents. The ability to control the cure rate of the polyurethane 74 is an additional advantage of the process of the present invention. Polyurethane 74 cures at a rate at which it does not drop off of the roll onto the floor, thus avoiding a post-cure waiting period of time.

It should be noted that the polyurethane may be of any desired color. Depending on the pigmentation used, however, and how that pigment is saturated and mixed into polyurethane 74, pigmentation may affect the viscosity of polyurethane 74. Thus, cure rate may also be affected by additives to polyurethane 74.

Different types of polyurethane 74 may be used in the method 10 and system 20 of the present invention. Various additives and/or fillers may optionally be added to either component, either resin or curative, prior to preparation of the polyurethane for additional advantages. The polyurethane 74 may include, for example but not limited to, any one or any combination of the following: silica; clay; isocyanates, for example, polymeric diphenylmethane diisocyanate; polyester polyol; polyether polyol; amines; polytetrafluoroethylene, or Teflon®; dyes or pigments, e.g., iron oxide, titanium oxide, and/or chromium oxide; nanoparticles; epoxies; graphite; high density polyethylene; and/or fibers. Fibers that may be added to either of the polyurethane components include, for example, but are not limited to, fibers that may include meta- or para-aramids or silica (e.g., glass fibers).

Figure 1:
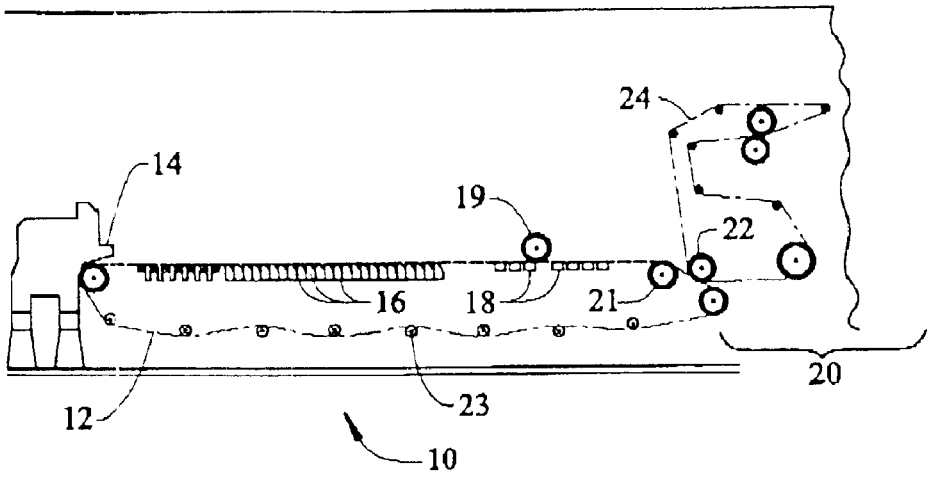
FIG. 1 PRIOR ART
FIG. 1 is a side view of the wet end of a prior art papermaking machine.
Figure 2:
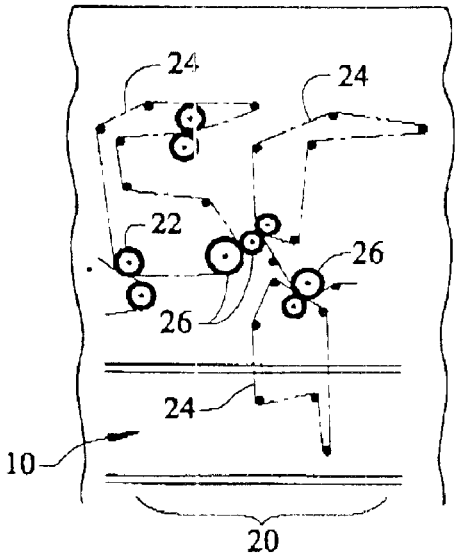
FIG. 2 PRIOR ART
FIG. 2 is a side view of a press section 20 of the papermaking machine of FIG. 1.
Figure 4:
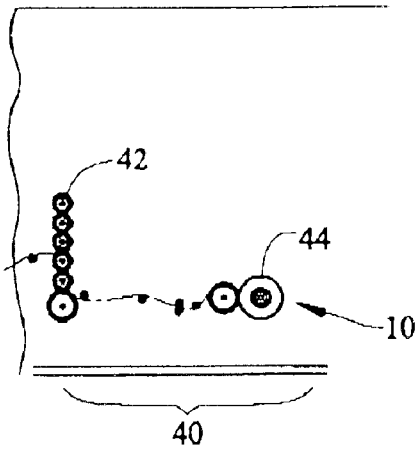
FIG. 4 PRIOR ART
FIG. 4 is a side view of the end of the papermaking machine of FIGS. 1–3.
Figure 3:
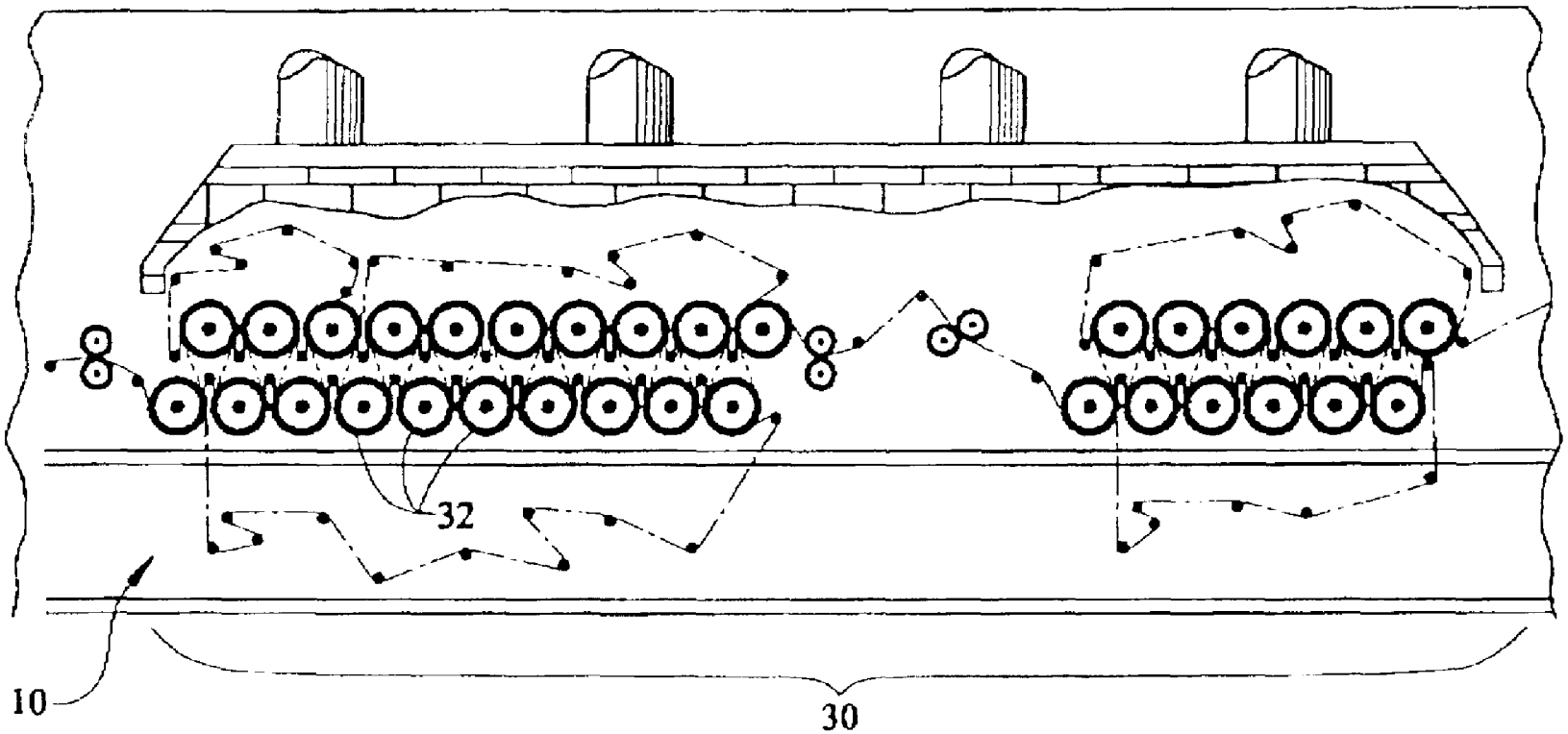
FIG. 3 PRIOR ART
FIG. 3 is a side view of the dryer section of the papermaking machine of FIGS. 1 and 2.

Silica may be added to aid in the attraction of the polyurethane 74 for the web 12 in a typical papermaking machine 10 (FIGS. 1–3). Polyurethane 74 with silica additives enables a tighter turn-up and seizes the paper better for a tighter line.

Polyurethane 74 may incorporate Teflon® which increases the release properties of the roll, whether it is the sheet that is being released, or the prevention of pulp build up. Further, with recycled fiber, there are often glues, pitches, tars, etc. that tend to adhere to certain surfaces and Teflon® in the polyurethane resists those particles from adhering to the roll cover.

Fillers or additives in polyurethane 74 can cause the polyurethane 34 to be hydrophobic. Rolls covered with hydrophobic polyurethane can run continuously on the wet end of the papermaking machine 10 (FIG. 1) without absorbing water. Thus, the polyurethane covered rolls, covered by the method of the present invention, are more hydrolytically stable than rolls covered by traditional processes. Additionally, the polyurethane 74 need not incorporate any additional additives if the above-mentioned properties imparted by the additives are not desired or needed.

It should be emphasized that the above-described embodiments of the present invention, particularly, any "preferred" embodiments, are merely possible examples of implementations, and are merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention, and protected by the following claims.

Having thus described the invention, at least the following is claimed:

1. A method for covering a cylindrical roll with polyurethane, comprising the steps of:

providing a cylindrical roll having two ends and a surface, wherein the cylindrical roll is attached to a variable speed turning fixture on said ends of the roll;

providing a variable speed traversing mechanism having a nozzle;

providing polyurethane wherein providing polyurethane comprises dispensing polyurethane via a spray dispensing mechanism; and covering the surface of the roll with up to three inches thick of polyurethane in one pass of the traversing mechanism along the length of the roll while rotating the roll via the variable speed turning fixture, wherein covering the surface of the roll comprises rotating the roll at a rate wherein, after a first portion of polyurethane contacts a longitudinal portion of the roll, most of the polyurethane dispensed from the dispensing mechanism contacts polyurethane already covering the roll, wherein the polyurethane already covering the roll has a thickness of up to approximately three inches with a viscosity of approximately 10,000 centipoises in the liquid state prior to hardening.

2. The method of claim 1, wherein the roll includes at least one of the following types of rolls used in the paper-making industry: breast rolls, wire rolls, wire return rolls, wire turning rolls, wire drive rolls, felt rolls, paper rolls, stretch rolls, guide rolls, press rolls, suction rolls, fly rolls, breaker stack rolls, size press rolls, lead-in and lead-out rolls, coater rolls, coater backing rolls, dryer felt rolls and reel spools.

3. The method of claim 1, wherein providing polyurethane comprises dispensing polyurethane made from components of polyurethane mixed and atomized at pressures from 1,000 pounds per square inch (psi) to 5,000 psi immediately prior to dispensing.

4. The method of claim 3, wherein the components of polyurethane consist essentially of: a curative; a resin; and at least one of an additive and filler for at least one of the curative and resin.

5. The method of claim 4, wherein at least one of the additives and fillers may be chosen from at least one of: silicas; clays; isocyanates; polyester polyols; polyether polyols; amines; polytetrafluoroethylene; pigments; nanoparticles; epoxies; graphite; high density polyethylene; fibers; additional curative; and additional resin.

6. The method of claim 1, wherein the polyurethane already covering the roll has a viscosity wherein it homogenizes with the polyurethane being dispensed from the dispensing mechanism.

7. The method of claim 1, wherein the polyurethane already covering the roll has a viscosity wherein it does not drip off the roll as the roll rotates.

8. The method of claim 1, wherein covering the surface of the roll comprises dispensing polyurethane in a fan-shaped configuration onto the surface of the roll.

9. The method of claim 8, wherein the polyurethane being dispensed covers from approximately six to approximately thirty-six inches of the longitudinal portion of the roll.

10. The method of claim 8, wherein covering the surface of the roll comprises rotating the roll at a rate wherein approximately 20% of the fan-shaped configuration of the polyurethane being dispensed contacts an uncovered longitudinal portion of the roll during each revolution.

11. The method of claim 1, wherein covering the surface of the roll comprises dispensing atomized polyurethane.

12. The method of claim 1, wherein the polyurethane is dispensed at a pressure from approximately 1,000 pounds per square inch (psi) to approximately 5,000 psi.

13. The method of claim 1, wherein the method does not require a post-covering cure time.

14. The method of claim 1, wherein, at a temperature maintained at approximately 70° F., and within approximately 2.5 to approximately 3.5 hours after covering the roll, the covered roll is substantially cured wherein the roll is able to be subjected to machine grinding.

15. The method of claim 1, wherein, immediately after covering, the covered roll while being maintained at a temperature of approximately 70° F. is approximately 85% of its ultimate hardness.

16. A method for covering a cylindrical roll with polyurethane, comprising the steps of:

providing a cylindrical roll having two ends and a surface, wherein the cylindrical roll is attached to a variable speed turning fixture on said ends of the roll;

providing a variable speed traversing mechanism having a nozzle;

providing polyurethane wherein providing polyurethane comprises dispensing polyurethane via a spray dispensing mechanism; and covering the surface of the roll with up to three inches thick of polyurethane in one pass of the traversing mechanism alone the length of the roll while rotating the roll via the variable speed turning fixture, wherein covering the surface of the roll comprises rotating the roll at a rate wherein, after a first portion of polyurethane contacts a longitudinal portion of the roll, most of the polyurethane dispensed from the dispensing mechanism contacts polyurethane already covering the roll, and wherein covering the surface of the roll further comprises depositing multiple layers of polyurethane on each portion of the roll, and wherein the polyurethane layers are of a viscosity that the layers homogenize as the polyurethane cures, forming a homogeneous single covering of polyurethane without layers from approximately one to approximately three inches thick in one traverse of the dispensing mechanism down the roll.

17. A method for covering a cylindrical roll with polyurethane, comprising the steps of:

providing a cylindrical roll having two ends and a surface, wherein the cylindrical roll is attached to a variable speed turning fixture on said ends of the roll;

providing a variable speed traversing mechanism having a nozzle;

providing polyurethane; and covering the surface of the roll with up to three inches thick of polyurethane in one pass of the traversing mechanism alone the length of the roll while rotating the roll via the variable speed turning fixture, wherein the surface of the roll is covered from approximately one-quarter (¼) inch up to approximately three inches of polyurethane in one pass of the traversing mechanism.

18. A method of covering a cylindrical roll, comprising:

providing a cylindrical roll having first and second opposed ends and a cylindrical surface disposed between said opposed ends, the cylindrical surface having a longitudinal axis of rotation extending through said ends, rotating said roll about said longitudinal axis of rotation, advancing a spray nozzle in one pass from said first end toward said second end of said roll as said roll rotates, applying polyurethane through said spray nozzle to said cylindrical surface of said cylindrical roll as said spray nozzle advances from said first end toward said second end of said cylindrical roll, coordinating the rotational velocity of said cylindrical roll with the rate that the polyurethane is applied to said cylindrical surface so that the layer of polyurethane applied to the cylindrical surface does not fall from the cylindrical surface, and the layer of polyurethane on the cylindrical surface applied on a previous rotation of the cylindrical roll is not completely cured after a rotation of the cylindrical roll, and the polyurethane being applied by the spray nozzle to the cylindrical surface becomes homogeneous with the previous layer of polyurethane applied to the cylindrical surface, wherein a layer of approximately $\frac{1}{2{,}000}$ inch to approximately $\frac{1}{10{,}000}$ inch thick polyurethane applied in a spray at a temperature of approximately 110 degrees F to a surface of the roll at approximately 70 degree F. to 73 degrees F. at a pressure of approximately 2,500 psi maintains a viscosity for approximately five to 30 seconds wherein the polyurethane being applied to the surface becomes homogenous with the previous layer of polyurethane applied to the surface.

19. The method of claim 18, wherein coordinating the rational velocity of said cylindrical roll comprises completing one rotation of the cylindrical roll prior to the curing time required for the previously applied layer of polyurethane.

* * * * *